US011772927B2

(12) United States Patent
Bahmer et al.

(10) Patent No.: US 11,772,927 B2
(45) Date of Patent: Oct. 3, 2023

(54) CROSS-FOLD MODULE FOR A FOLDING MACHINE, AND FOLDING MACHINE EQUIPPED THEREWITH

(71) Applicant: H+H GmbH & Co. KG, Bielefeld (DE)

(72) Inventors: Frank Bahmer, Bielefeld (DE); Eduard Melcher, Bielefeld (DE)

(73) Assignee: H+H GMBH & CO. KG, Bielefeld (DE)

( * ) Notice: Subject to any disclaimer, the term of this patent is extended or adjusted under 35 U.S.C. 154(b) by 0 days.

(21) Appl. No.: 17/965,320

(22) Filed: Oct. 13, 2022

(65) Prior Publication Data

US 2023/0123359 A1 Apr. 20, 2023

(30) Foreign Application Priority Data

Oct. 14, 2021 (EP) ..... 21202689

(51) Int. Cl.
*B65H 45/18* (2006.01)
*B65H 45/16* (2006.01)

(52) U.S. Cl.
CPC ..... *B65H 45/164* (2013.01); *B65H 2404/254* (2013.01)

(58) Field of Classification Search
CPC .... B65H 45/18; B65H 45/142; B65H 45/164; B65H 2404/2613; B65H 2404/2693; B65H 2404/254; B65H 2301/3421; B65H 2801/24
USPC ..... 270/32; 493/416–422, 436–440
See application file for complete search history.

(56) References Cited

U.S. PATENT DOCUMENTS 4,516,759 A * 5/1985 Kobler ..... B65H 45/12 101/232
4,682,767 A 7/1987 Littleton
6,305,146 B1 * 10/2001 Gerber ..... B65B 9/02 493/437
6,309,336 B1 * 10/2001 Muessig ..... B65H 45/12 493/437
7,077,798 B2 * 7/2006 Kawatsu ..... B65H 45/18 493/434

(Continued)

FOREIGN PATENT DOCUMENTS

EP 1475337 B1 4/2008
JP 2556511 B2 * 11/1996
NL 7200495 A 7/1973

OTHER PUBLICATIONS

European Search Report dated Mar. 25, 2022, 2 Pages.

*Primary Examiner* — Leslie A Nicholson, III
(74) *Attorney, Agent, or Firm* — LUCAS & MERCANTI, LLP

(57) ABSTRACT

The cross-fold module for a folding machine comprises a cross-fold knife which is movable in a reciprocating manner in a folding-knife movement direction, and a pair of folding rollers which form a folding roller gap in which a sheet that previously was fed in the feeding direction is creased for folding by the cross-fold knife. A delivery transport device for the folded product receives the folded product in a receiving portion close to an outlet of the folding roller gap and transports the folded product to a delivery portion. At least the cross-fold knife and the pair of folding rollers are adjustable horizontally, perpendicular to the folding-knife movement direction and perpendicular to the feeding direction.

13 Claims, 7 Drawing Sheets

(56) References Cited

U.S. PATENT DOCUMENTS

| | | | | |
|---|---|---|---|---|
| 9,126,798 | B2 * | 9/2015 | Yamamoto | B65H 45/18 |
| 11,091,346 | B2 * | 8/2021 | Yamamoto | B65H 29/52 |

* cited by examiner

CROSS-FOLD MODULE FOR A FOLDING MACHINE, AND FOLDING MACHINE EQUIPPED THEREWITH

CROSS-REFERENCE TO RELATED APPLICATION

The present application which claims priority of EP 21 202 689.2, filed Oct. 14, 2021, the priority of this application is hereby claimed, and this application is incorporated herein by reference.

BACKGROUND OF THE INVENTION

The present invention relates to a cross-fold module for a folding machine, and to a folding machine equipped therewith.

Folding machines for producing folded products typically comprise a plurality of different folding units. In general, a distinction is made here between buckle-plate folding units and knife folding units. In order to obtain a product that is folded as desired and has different folding directions, it is usually necessary for buckle-plate folding units and knife folding units to be combined. For example, a multi-buckle-plate folding machine first generates a plurality of parallel folds in the folded product. The cross fold is then generated by a further buckle-plate folding unit or a knife folding unit, which is potentially being followed by a knife folding unit.

SUMMARY OF THE INVENTION

It is an object of the present invention to provide a cross-fold module and a folding machine equipped therewith which enable a high degree of flexibility and diversity in the design of folded products.

According to an aspect of the invention, the cross-fold module for a folding machine comprises a bearing installation on which a preferably pre-folded sheet in a transport plane being infed in a feeding direction at least partially comes to bear, and a stop member against which a leading edge of the infed sheet comes to abut. The cross-fold module further comprises a cross-fold knife which is arranged above the bearing installation, extends in the feeding direction and is movable in a reciprocating manner in a folding-knife movement direction perpendicular to the feeding direction, and a pair of folding rollers which are arranged below the bearing installation and opposite the cross-fold knife and which form a folding roller gap in which a sheet is creased by the cross-fold knife for folding, thus forming a folded product. Finally, the cross-fold module comprises a delivery transport device for the folded product, which is configured to receive the folded product in a receiving portion close to an outlet of the folding roller gap and to transport the folded product to a delivery portion in a direction transverse to the feeding direction and transverse to the folding-knife moving direction. The cross-fold knife and the pair of folding rollers are adjustable in a direction transverse to the feeding direction and transverse to the folding-knife movement direction. The delivery transport device is formed by at least one pair of continuous, driven belts which are directly mutually opposite in at least one transport portion, extending from the receiving portion to the delivery portion, and between which the folded product is sandwiched in the transport portion. The length of the transport portion is variable, or varied, respectively, during the adjustment of the cross-fold knife and of the pair of folding rollers.

The folded product, while being transported, should preferably not be completely covered by the belts so that the folded product while being conveyed is accessible for processing and/or quality control.

At least two pairs of belts which are disposed so as to be mutually spaced apart are usually present, wherein each pair of belts therebetween clamps a specific portion of the folded product in the transport portion.

The direction in the adjustment of the cross-fold knife and of the pair of folding rollers is in general preferably perpendicular to the feeding direction and perpendicular to the folding-knife movement direction.

The adjustment of the cross-fold knife and of the pair of folding rollers can take place in two respectively opposite directions. The adjustment typically takes place by a linear displacement.

An adjustment range of the cross-fold knife and of the pair of folding rollers is usually between +20 cm and −20 cm, preferably between +15 cm and −15 cm, measured from the central position.

Eccentric folding of the sheet can be achieved as a result of the adjustment, which can be utilized for a multiplicity of different folding patterns. Overall, the variability in terms of the folded products manufactured is increased.

In a preferred embodiment the receiving portion of the delivery transport device, jointly with the cross-fold knife and the pair of folding rollers, is adjustable in the same direction as the cross-fold knife and the pair of folding rollers in such a manner that a relative position of the receiving portion and the folding roller gap remains the same.

The delivery portion of the delivery transport device preferably remains stationary during the adjustment of the receiving portion. In this way, subsequent modules of the folding machine can always acquire the folded products from the cross-fold module at the same location.

The belts are preferably guided about a plurality of deflection rollers, wherein per belt at least two of the deflection rollers, jointly with the cross-fold knife and the pair of folding rollers, are adjustable in the same direction as the cross-fold knife and the pair of folding rollers.

Each belt preferably forms a U-shaped loop about one of the adjustable deflection rollers. As a result, a belt accumulator which ensures length compensation during adjusting is formed.

The belt accumulator formed by the U-shaped loop is then filled or emptied during the adjustment of the deflection rollers.

Preferably at least the cross-fold knife and the pair of folding rollers, more preferably all adjustable components, are fastened to a horizontally displaceable sliding frame.

The cross-fold module preferably comprises an infeed transport device which, particularly preferably likewise jointly with the cross-fold knife and the pair of folding rollers, is adjustable in the same direction as the cross-fold knife and the pair of folding rollers.

The infeed transport device is preferably formed by at least one pair of mutually opposite, continuous belts that therebetween receive the sheet.

The adjustment can be performed manually. The manual activation element can be, for example, a hand wheel for adjusting the cross-fold knife and the pair of folding rollers, or also all other remaining adjustable components, respectively. A motorized drive which is preferably actuated in an automated manner can also be provided for this purpose.

According to another aspect of the invention, a folding machine comprises a cross-fold module as described above.

The folding machine, upstream of the cross-fold module, preferably moreover has a buckle-plate folding unit which is configured to fold the sheet multiple times in parallel in a first direction. The cross-fold knife in this instance is configured to fold the pre-folded sheet in a direction perpendicular to the first direction.

The folding machine, downstream of the cross-fold module, preferably comprises at least one further folding unit, preferably a plurality of folding units, which performs at least one further fold, preferably a plurality of folds, of the folded product in the second direction. These further folding units can be knife folding units, for example.

The cross-fold module of the invention or the folding machine of the invention can be used during the folding of any desired printed sheet. Package inserts, also in the form of outserts, can inter alia be folded while using the cross-fold module according to the invention.

In the context of this application, the term "sheet" designates the product being fed into the cross-fold module. This may be a non-folded sheet or an already pre-folded sheet. In contrast, the term "folded product" designates the product after cross-folding in the cross-fold module. The folded product can be further folded in subsequent stations.

The sheet is typically a sheet of paper, paperboard or a similar material. As mentioned, the sheet may be an as yet non-folded planar medium, but is preferably a sheet which has already been folded once or multiple times. In the latter case, the cross-fold module generates a further fold, in addition to one or a plurality of already existing folds, in a direction perpendicular to the direction of the first fold or folds.

The cross-fold module preferably processes successive individual sheets.

In general, the folding machine is preferably used as a paper folding machine, in particular in the processing of thin printing paper.

DETAILED DESCRIPTION OF SPECIFIC EMBODIMENTS

Figure 1:
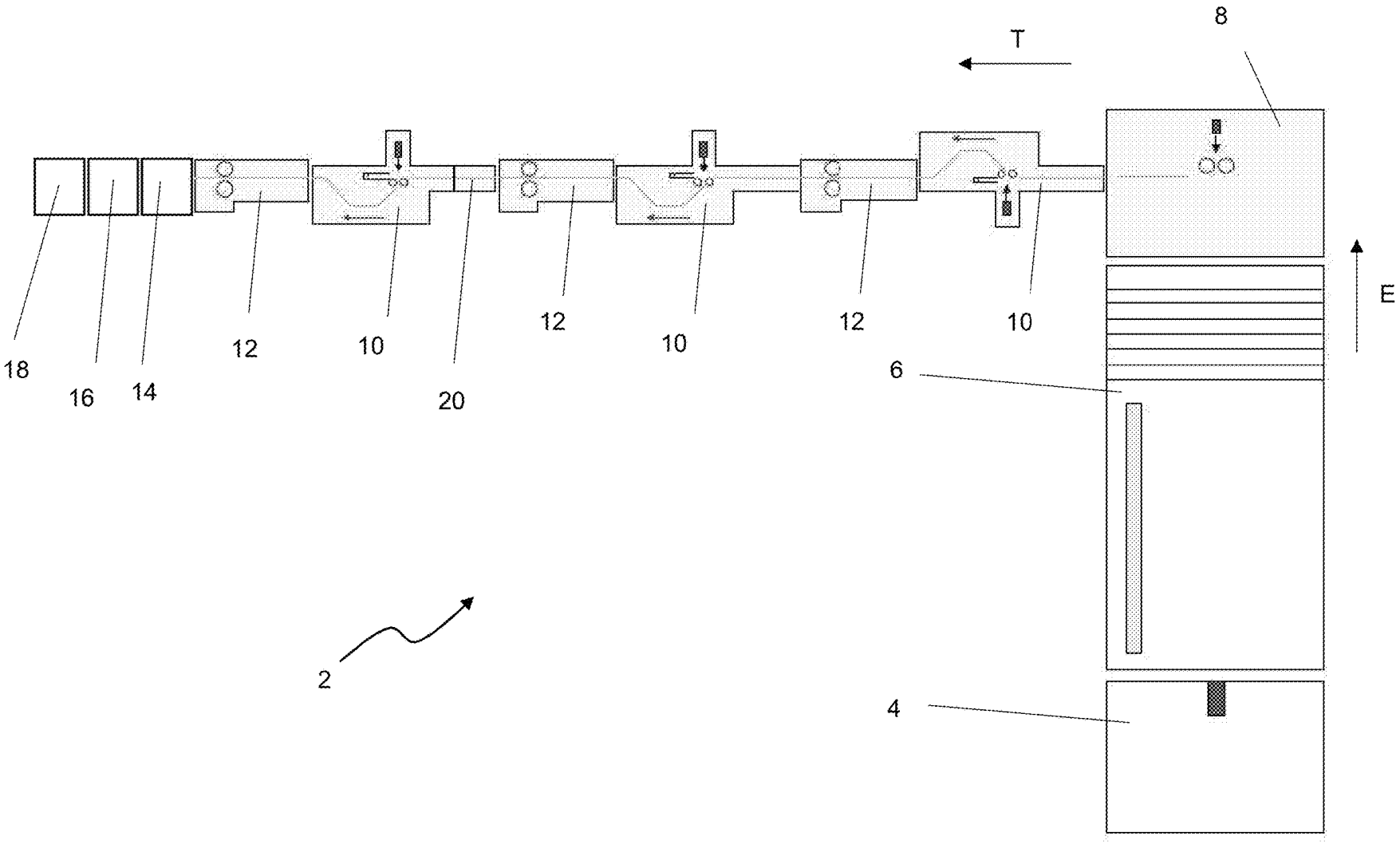
FIG. 1 shows a plan view from above of an embodiment of a folding machine including an embodiment of a cross-fold module according to the invention.

FIG. 1 shows a schematic illustration of an embodiment of a folding machine 2 in a plan view from above.

The folding machine 2 first comprises a feeder 4, preferably for feeding and singularizing sheets which can be provided as a stack in the feeder 4.

The folding machine 2 furthermore comprises a buckle-plate folding unit 6 which is arranged downstream of the feeder 4. The feeder 4 extracts in each case one sheet from the stack and supplies said sheet to the buckle-plate folding unit 6. The buckle-plate folding unit 6 is preferably configured to fold the sheet multiple times in such a manner that the folds run parallel to a first direction, a plurality of parallel folds thus being generated in the sheet.

A cross fold is subsequently incorporated in the sheet in the cross-fold module 8. This fold is performed parallel to the feeding direction E of the sheet. The cross-fold module 8 dispenses the folded products to the further stations in a modified transport direction T, the latter being typically offset to the feeding direction E by 90°.

The cross-fold module 8 thus generates a fold which runs in a second direction, perpendicular to the first direction.

Further folding units 10, which in the exemplary embodiment illustrated are configured as knife folding units, can subsequently follow. A press 12 for compressing the folded product after the respective folding action can optionally be provided after each folding unit 10.

The type, number and sequence of the folding units 10 can be adapted in an arbitrary manner to the existing requirements and to the desired configuration of the folded product to be produced. It is thus possible for a person skilled in the art to adapt the folding machine 2 in order to produce a multiplicity of different folded products.

It is likewise possible for a buckle-plate folding unit to be provided also in the cross-fold region, said buckle-plate folding unit performing one or a plurality of parallel folds in the second direction, the latter being perpendicular to the first direction in which the folds run that were formed in the buckle-plate folding unit 6.

Finally, at least one knife folding unit can also be used additionally to the buckle-plate folding unit 6, so as to perform at least one further fold in the first direction, parallel to the folds of the buckle-plate folding unit 6 in FIG. 1, ahead of the cross-fold module 8.

A preferred embodiment, which is illustrated in FIG. 1, shows three further folding units 10 after the cross-fold module 8. One or two folding units 10 may also be omitted when only two or three folds are to be carried out in the second direction. It is likewise possible for a further folding unit 10 to be added in the cross-fold region.

A device 14 for quality control, for example with one or with two digital cameras can optionally be provided downstream of the last folding unit 10, said device 14 for quality control checking the orientation of the folded product and of the last folded edge, and/or the thickness of the folded products. If all criteria mentioned are to be checked, two cameras having mutually perpendicular inspection fields are required. A device 16 for ejecting faulty folded products can be provided so as to adjoin the device 14 for quality control, said device 16 for ejecting faulty folded products being able to be actuated based on the evaluation results of the device 14 for quality control.

A stacking unit 18 for forming stacks of folded products can likewise be optionally provided.

One of the described layouts of the folding machine can be particularly advantageously used in the production of folded products so as to produce folded products, in particular outserts, having at least 54, preferably at least 72, more preferably at least 90, even more preferably at least 108 panels, most preferably at least 120 panels up to 300 panels, or even more. In the process, at least eight, preferably at least ten, more preferably at least twelve folds are carried out in the first direction, and at least three folds, preferably at least four folds, are carried out in the second direction.

In the production of outserts, at least one glue spot, ahead of the last fold, is applied to the folded product by means of a device 20, so as to keep the folded product in the closed state after the last folding action. Alternatively thereto, an adhesive label can also be applied by the device 20, said adhesive label, after the last folding action, being wrapped about an edge of the folded product and in the final state being fastened to two opposite sides of the folded product so as to keep the folded product in the closed state. In this instance, the device 20 can also be arranged after the last folding unit 10.

In all embodiments, the transfer of the folded products between the folding units 8, 10 at least in portions takes place while using conveying means which are preferably formed by pairs of belts, wherein one portion of the folded product is in each case firmly held between the belts of one pair of belts. The pairs of belts are arranged so as to be mutually parallel and spaced apart in the transverse direction.

Figure 2:
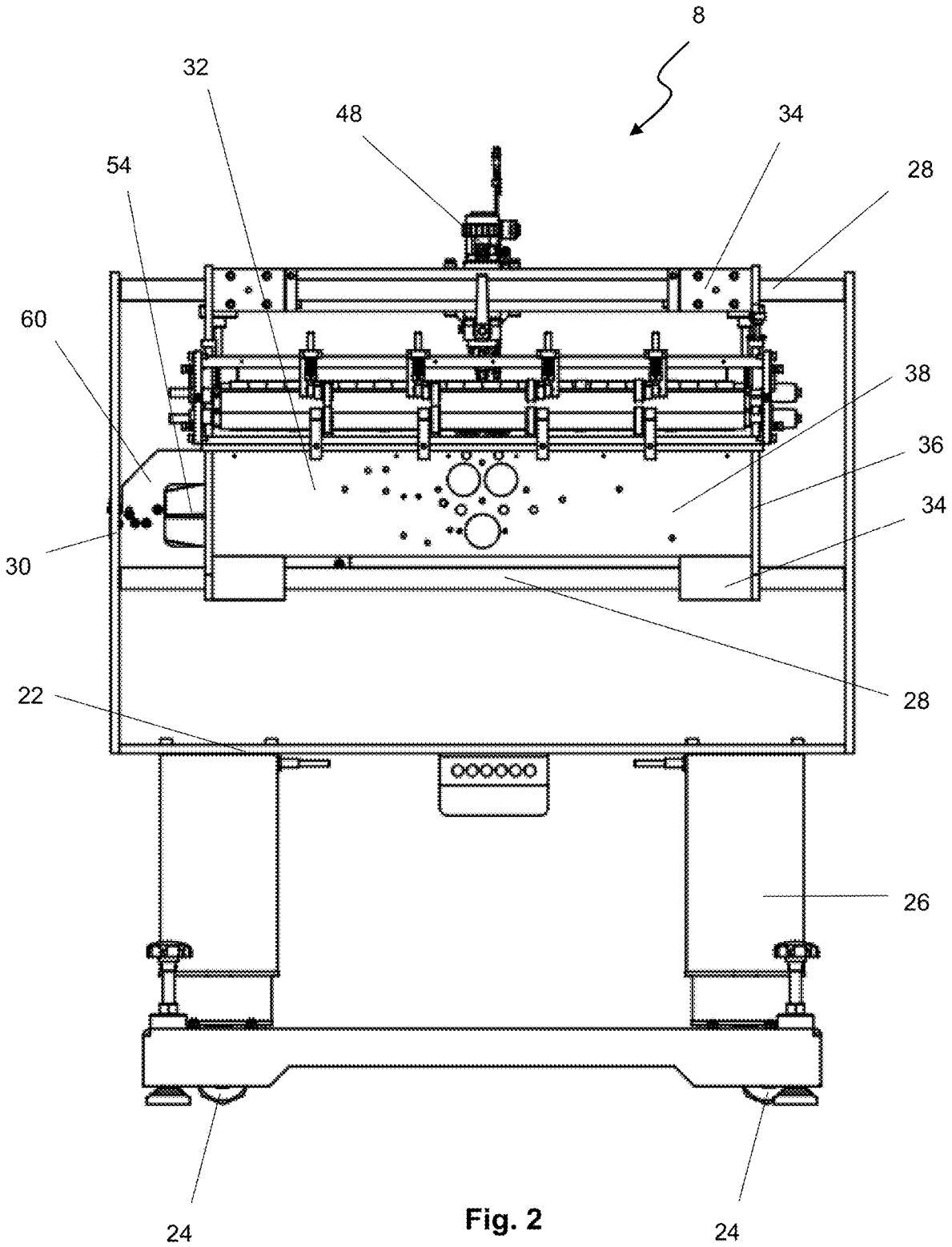
FIG. 2 shows a front view of an embodiment of a cross-fold module according to the invention, in which the cross-fold knife is arranged in a central position.
Figure 3:
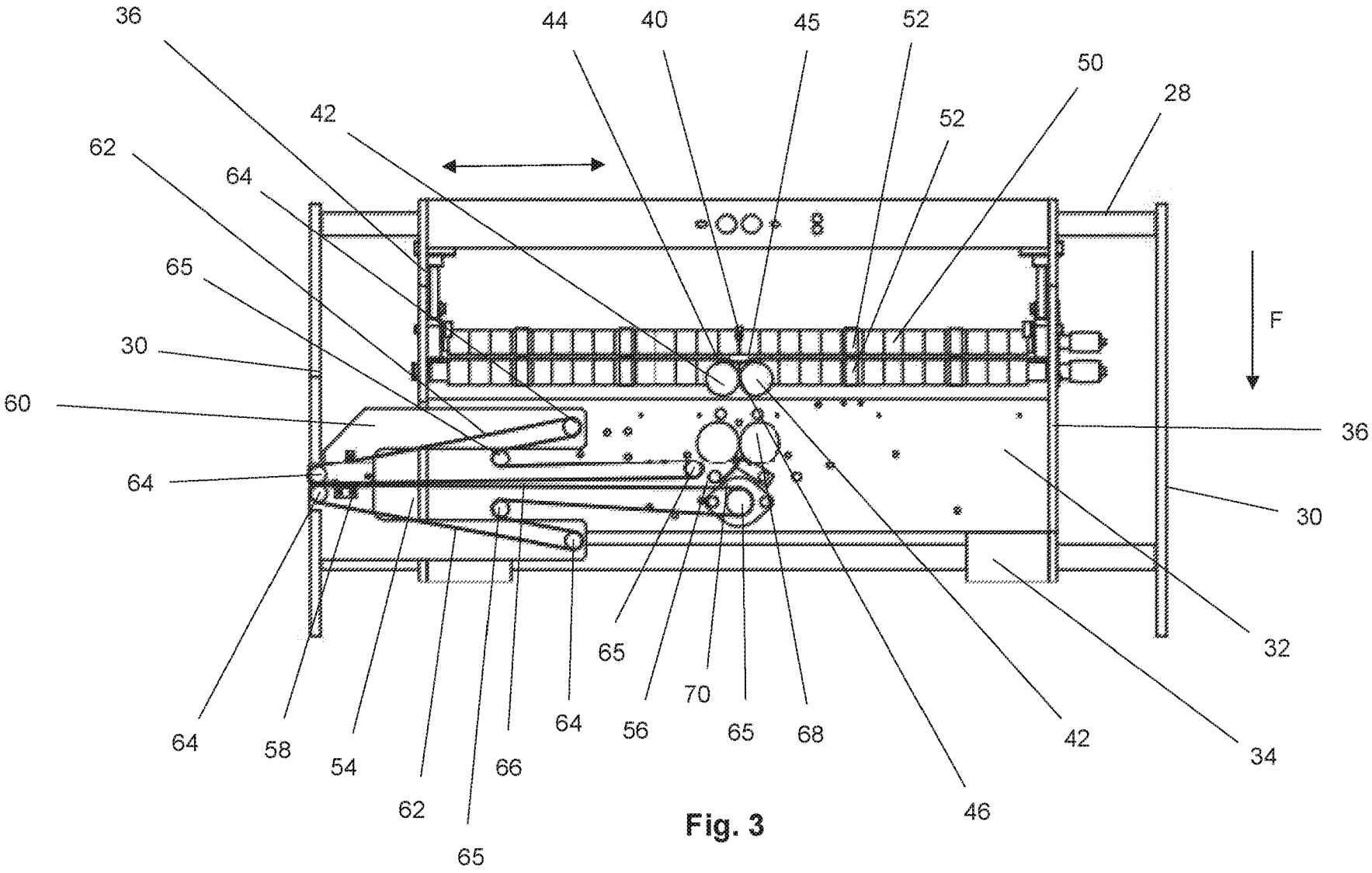
FIG. 3 shows a cross-sectional view of relevant components of the cross-fold module from FIG. 2.

An exemplary embodiment of a cross-fold module 8 according to the invention is illustrated in FIGS. 2 and 3. According to FIG. 2, the cross-fold module 8 comprises a machine frame 22 which is mounted so as to be displaceable on wheels 24. Lifting columns 26 serve for adjusting the height. Horizontally running rails 28 are configured in the interior of the machine frame 22 above the lifting columns 26. Only two rails 28 can be seen in the view illustrated in FIG. 2, but a total of preferably four rails 28 are present, in each case two upper rails and two lower rails, of which one upper and one lower rail are disposed closer to the entry region of the cross-fold module 8, and the further pair of rails is disposed further toward the rear, into the drawing plane, in comparison to the first pair. This overall preferably results in a symmetrical disposal of the rails 28 which, jointly with the side walls 30 of the machine frame 22, to which said rails 28 are rigidly connected, therebetween define a cuboid space.

A sliding frame 32 is displaceably mounted on the rails 28. The sliding frame 32 is disposed in the cuboid space. Eight bearing elements 34 on the sliding frame 32, which engage with the rails 28, are preferably provided for the connections to the rails 28. The bearing elements 34 preferably comprise wheels that roll on the rails. The sliding frame 32 moreover comprises two lateral side walls 36 as a left and a right delimitation of the sliding frame 32, as well as a front and a rear side wall 38 of which only the front side wall 38 can be seen in the illustration of FIG. 2. In this way, the sliding frame 32 is movable in a horizontal reciprocating manner along the rails 28 between the lateral side walls 36 of the machine frame 22, as is indicated by the double arrow in FIG. 3.

With reference to FIG. 3, one cross-fold knife 40 and one pair of folding rollers 42 are mounted on the sliding frame 32. As is usual, the cross-fold module 8 also comprises a bearing installation 44 on which a preferably pre-folded sheet, which is fed in the feeding direction E, at least partially comes to bear, and a stop member 45 against which a leading-edge of the fed sheet comes to about. The cross-fold knife 40 is disposed in the retracted position thereof above the bearing installation 44, and by way of the direction of main extent thereof extends in the feeding direction E, thus into the drawing plane in FIG. 3. The cross-fold knife 40 during operation, for carrying out the folds, is movable in a reciprocating manner in a folding-knife movement direction F perpendicular to the feeding direction E. The pair of folding rollers 42 is arranged below the bearing installation 44 and opposite the cross-fold knife 40, and forms a folding roller gap 46 in which a sheet for folding by the cross-fold knife 40 is creased, as a result of which a folded product is formed. The cross-fold knife 40, for generating the folding movement, is preferably driven by way of a pneumatic drive 48. In the folding movement, the cross-fold knife 40 penetrates a slot or any other opening of the bearing installation 44 so as to reach the proximity of the folding roller gap 46.

An infeed transport device 50, which is preferably likewise fastened to the sliding frame 32, guides each sheet in the feeding direction E to the cross-fold position. The infeed transport device 50 is formed by at least one pair, preferably a plurality of pairs, of in each case mutually opposite, continuously driven belts 52. The belts 52 in each case receive portions of the sheet therebetween. However, the infeed transport device 50 can also comprise any other conveying mechanism.

A delivery transport device 54 serves for acquiring the folded product after the cross fold and to direct the folded product to a subsequent apparatus of the folding machine. The delivery transport device 54 acquires the folded product in a receiving portion 54 close to an outlet of the folding roller gap 46 and in a direction which is transverse, preferably perpendicular, to the feeding direction E and transverse, preferably perpendicular, to the folding-knife movement direction F, conveys the folded product to a delivery portion 58. While the receiving portion 56 is movable in a reciprocating manner jointly with the sliding frame 32, the delivery portion 58 is fastened so as to be stationary on a delivery frame 60. The delivery frame 60 in turn is assembled on one of the side walls 30 of the machine frame 22. The delivery portion 58 may also be fixed in another manner as long as the delivery portion 58 remains stationary.

In the embodiment illustrated, the delivery transport device 54 is directed towards the left side of the cross-fold module 8. However, it is likewise possible for the delivery transport device 54 to be aligned mirror-symmetrically, towards the right side of the cross-fold module 8.

As is apparent from FIG. 3, the delivery transport device 54 in the exemplary embodiment illustrated comprises at least one pair of belts 62, each of which being guided by way of a plurality of deflection rollers 64, 65. Only two belts 62 can be seen in the illustration of FIG. 3. However, a plurality of belts 62 are typically disposed next to one another so as to be spaced apart into the drawing plane, said belts 62 running so as to be mutually parallel in each portion. One upper belt 62 and one lower belt 62 here form in each case an associated pair, said belts 62 interacting so as to transport a folded product from the receiving portion 52 to the delivery portion 58. The two belts 62 of each pair of belts run in direct proximity to one another in this transport portion 66, such that a portion of the folded product is received, preferably clamped, between the two belts 62. All upper belts preferably run in each case by way of the same deflection rollers, and all lower belts preferably run in each case by way of the same deflection rollers.

Outside the transport portion 68, the two belts 62 of each pair of belts are guided in a mutually separate manner, preferably mirror-symmetrically in relation to the transport portion 66. In the embodiment illustrated, each belt 62 runs about four deflection rollers 64, 65, of which the two deflection rollers 64 are in each case disposed so as to be stationary, the two deflection rollers 65 being displaceable jointly with the sliding frame 32. The two deflection rollers 65 here, like the folding rollers 42, are preferably rotatably mounted on the front and the rear side wall 38 of the sliding frame 32.

As a result of the interaction of the three deflection rollers 64, 65 that are disposed closer to the centre of the cross-fold module 8, each belt 62 runs in a U-shaped loop, wherein the curved portion of the U-shape runs about one of the adjustable deflection rollers 65.

Figure 4:
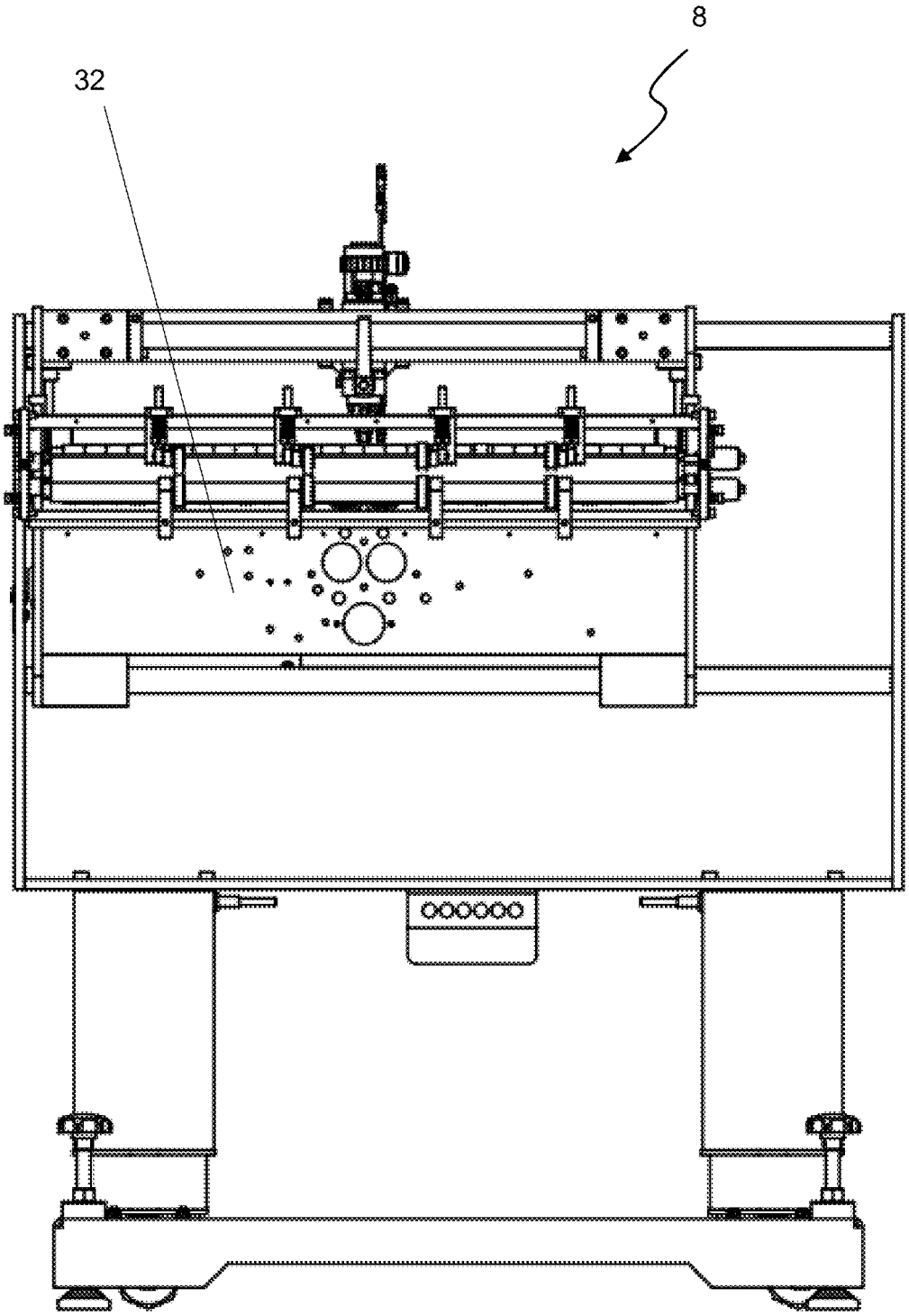
FIG. 4 shows a front view of the embodiment of the cross-fold module according to the invention from FIG. 2, wherein the cross-fold knife is arranged in a position displaced to the left.
Figure 5:
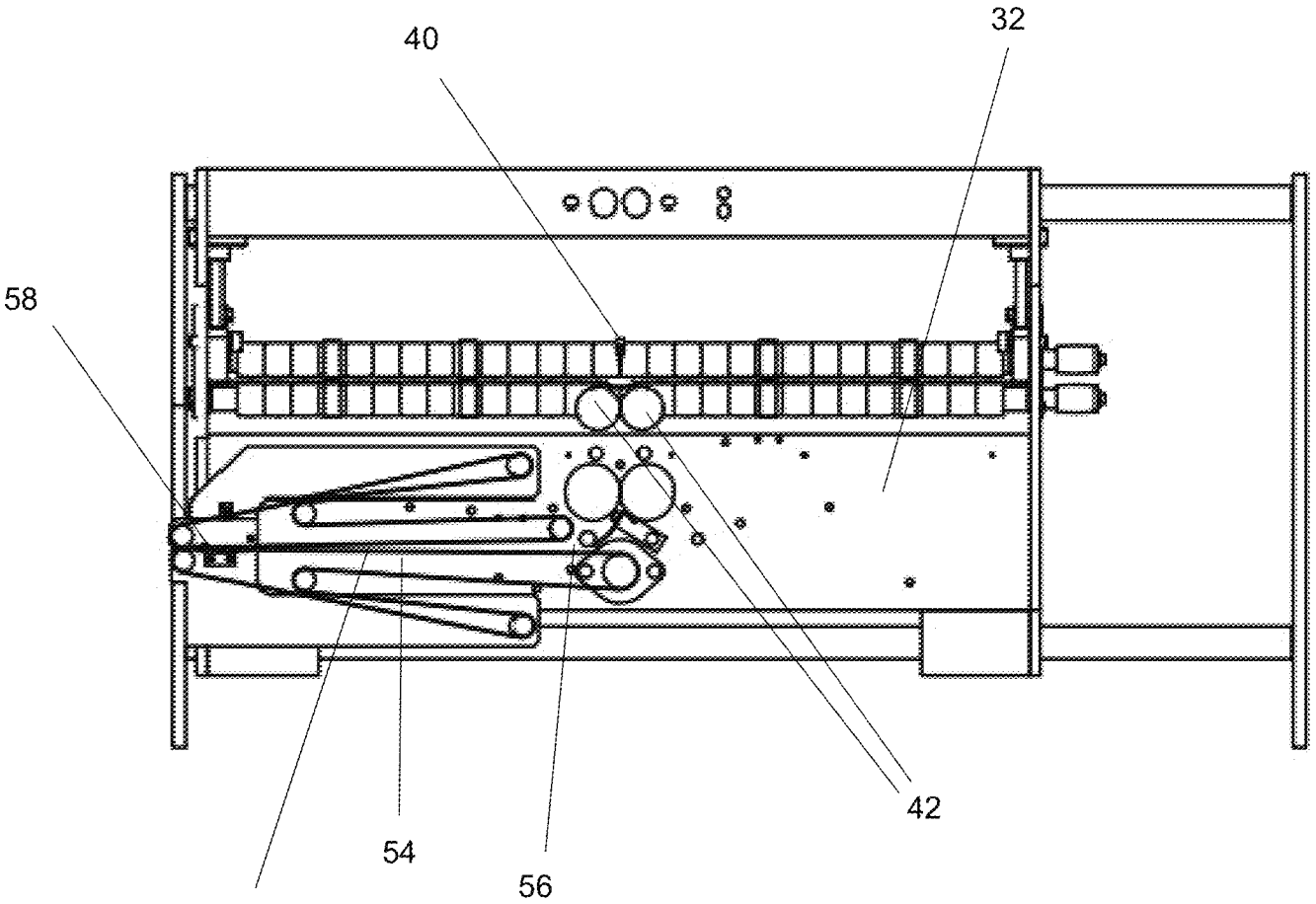
FIG. 5 shows a cross-sectional view of relevant components of the cross-fold module from FIG. 4.
Figure 7:
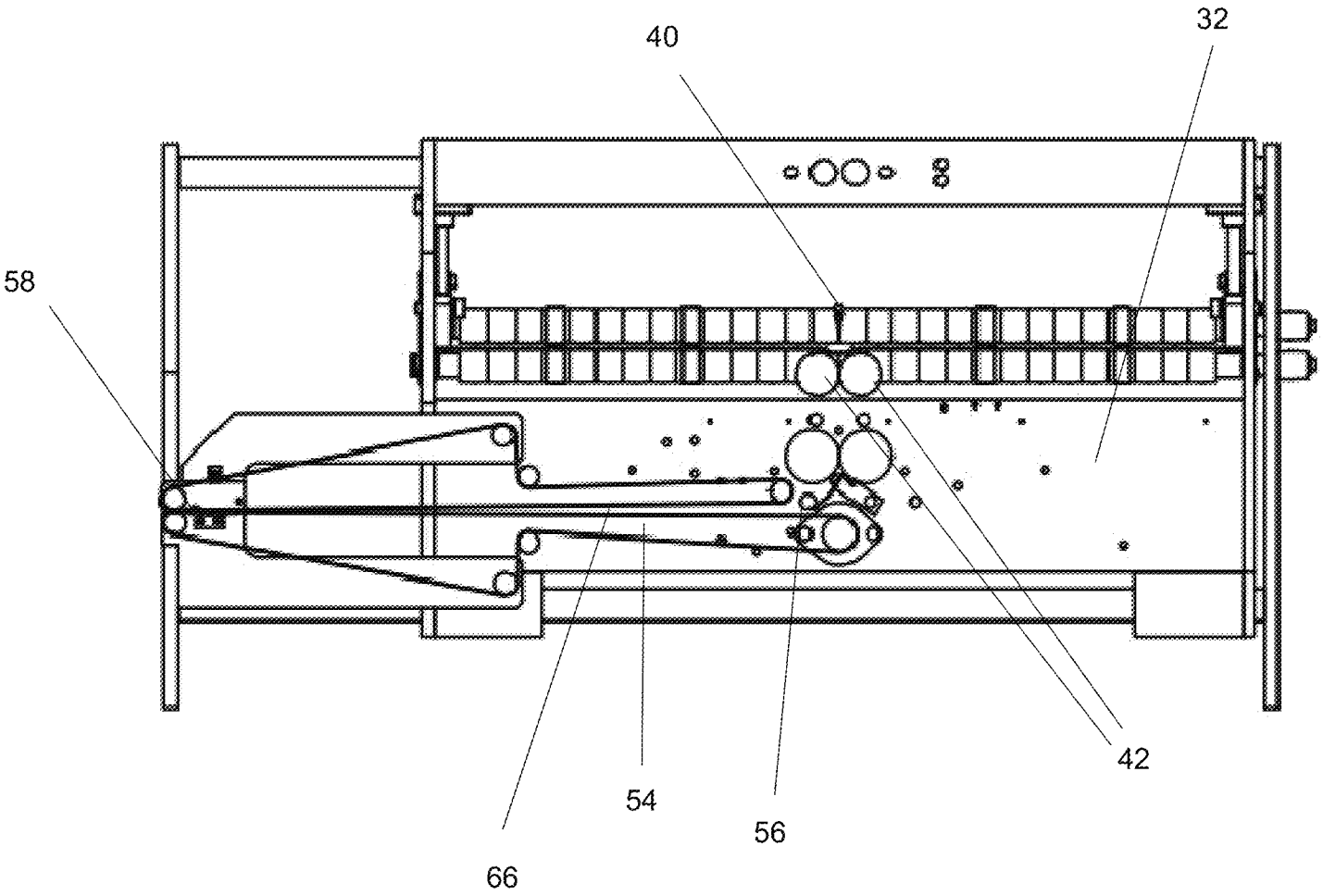
FIG. 7 shows a cross-sectional view of relevant components of the cross-fold module from FIG. 6.

In this way, a belt accumulator formed by the U-shaped loop is filled or emptied during the adjustment of the deflection rollers 65, as can be seen in FIGS. 5 and 7. The sliding frame 32 in FIGS. 4 and 5 is illustrated when displaced from the central position to an outer left position. As a result of the simultaneous displacement of the deflection rollers 65, the U-shaped loop is deformed in such a manner that both legs of the U-shape are approximately of equal length, while said two legs at the central position of the sliding frame 32 still have dissimilar lengths. The transport portion 66, in the position illustrated in FIGS. 4 and 5, is shortened in comparison to the central position of the sliding frame 32 from FIGS. 2 and 3, specifically by the amount of the displacement of the sliding frame 32.

The spacing between the two adjustable deflection rollers 65 remains the same in each state, and the length of the leg of the U-shape defined by the two deflection rollers 65 thus also always remains the same. It is only the length of the other leg of the U-shape that is varied during the displacement of the sliding frame 32.

Figure 6:
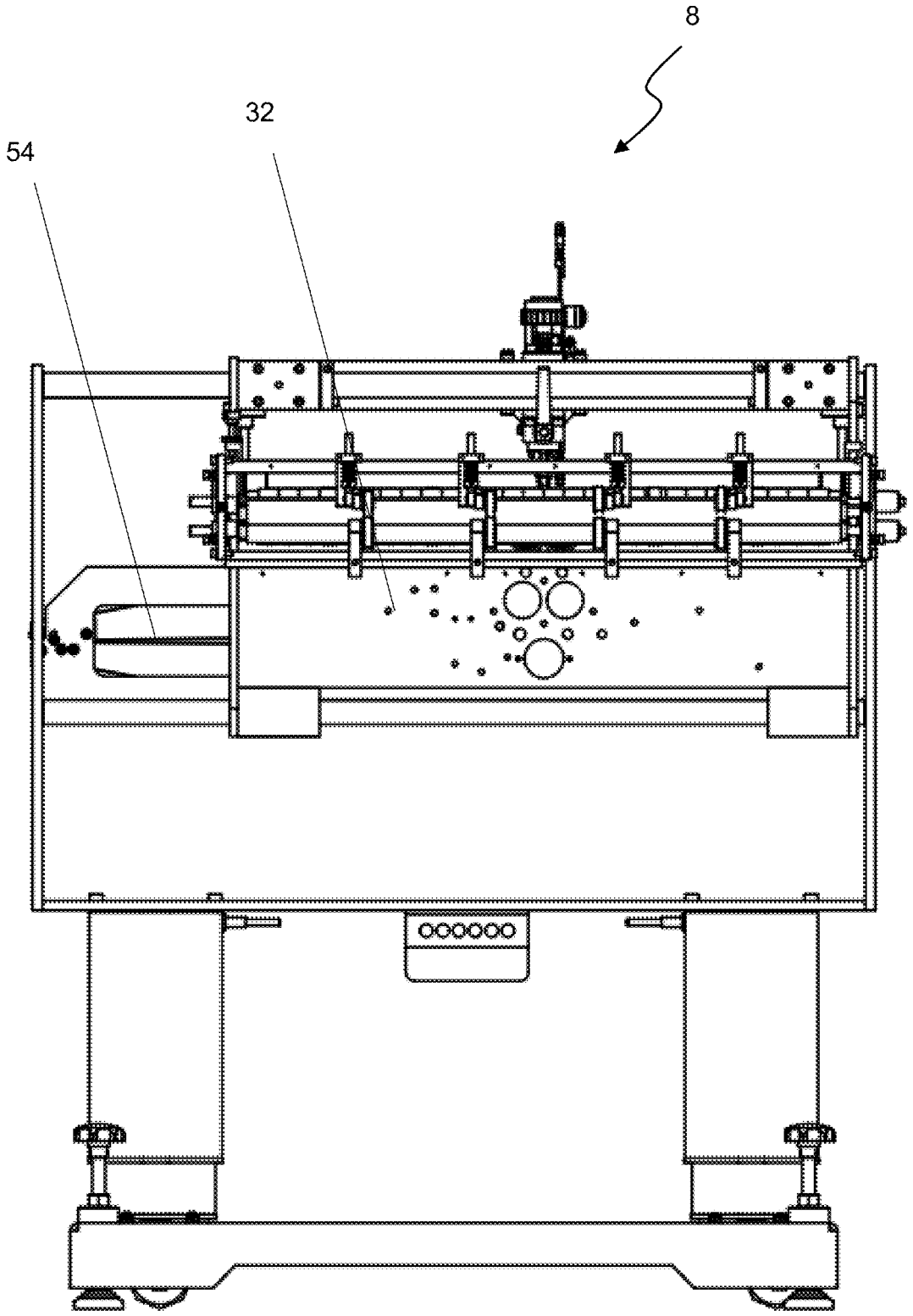
FIG. 6 shows a front view of the embodiment of the cross-fold module according to the invention from FIG. 2, wherein the cross-fold knife is arranged in a position displaced to the right.

The sliding frame 32 in FIGS. 6 and 7 is illustrated in an outer right position. The U-shape here is clearly modified, because the first leg of the U-shape has become very short as a result of the displacement of the deflection rollers 65 and the U-shape has obtained a larger opening angle. The transport portion 66 is increased in length in comparison to the central position of the sliding frame 32 from FIGS. 2 and 3, specifically by the amount of the displacement of the sliding frame 32 relative to the central position.

Apart from the embodiment described, there are many further possibilities in terms of the exact constructive design of the delivery transport device 54. In any case, it is important that the receiving portion 56 in the event of a lateral adjustment is moved jointly with the cross-fold knife 40 and the folding rollers 42. In contrast, the delivery portion 58 remains stationary so as to be able to transfer the folded products to subsequent apparatuses at a predefined position.

The running path of the belts 62 can also vary from the running path illustrated. In particular, other shapes of a belt accumulator can be configured, which lead to an increase in the length of the transport portion 66 when the receiving portion 56 is displaced away from the delivery portion 58, or which lead to a shortening of the transport portion 66 when the receiving portion 56 is displaced toward the delivery portion 58.

In the exemplary embodiment illustrated in the figures, the transfer of the folded products from the folding rollers 42 to the receiving portion 56 takes place by means of a few further transfer elements, in particular two further guide rollers 68 and one or a plurality of curved guide tongues 70, which are likewise moved jointly with the sliding frame 32. However, there are also many further possibilities for transferring the folded products to the receiving portion 56 of the delivery transport device 54.

It is preferable for all laterally adjustable components of the cross-fold module 8 to be in each case fastened to the sliding frame 32, and thus to be able to be displaced and firmly clamped simultaneously by way of only one action. However, it is also conceivable for the individual components to be in each case adjusted individually or in groups.

Apart from the preferred variant illustrated, it is likewise conceivable for only the cross-fold knife 40 and the folding rollers 42 to be adjusted, while a transfer mechanism, which is able to be lengthened or shortened, assumes the transfer of the folded products from the folding rollers 42 to a stationary delivery transport device 54.

The invention claimed is:

1. A cross-fold module for a folding machine, having:

a bearing installation on which a sheet being infed in a feeding direction at least partially comes to bear;

a stop member against which a leading edge of the infed sheet comes to abut;

a cross-fold knife which is arranged above the bearing installation, extends in the feeding direction and is movable in a reciprocating manner in a folding-knife movement direction perpendicular to the feeding direction;

a pair of folding rollers, which are arranged below the bearing installation and opposite the cross-fold knife, and which form a folding roller gap in which a sheet is creased by the cross-fold knife for folding, thus forming a folded product; and a delivery transport device for the folded product, which is configured to receive the folded product in a receiving portion close to an outlet of the folding roller gap and to transport the folded product to a delivery portion in a direction transverse to the feeding direction and transverse to the folding-knife movement direction;

wherein the cross-fold knife and the pair of folding rollers are adjustable in a direction transverse to the feeding direction and transverse to the folding-knife movement direction;

wherein the delivery transport device is formed by at least one pair of continuous, driven belts, which belts are directly mutually opposite at least in a transport portion extending from the receiving portion to the delivery portion, and between which belts a portion of the folded product is sandwiched in the transport portion, and wherein a length of the transport portion is variable during the adjustment of the cross-fold knife and the pair of folding rollers.

2. The cross-fold module according to claim 1, wherein the receiving portion of the delivery transport device, jointly with the cross-fold knife and the pair of folding rollers, is adjustable in the same direction as the cross-fold knife and the pair of folding rollers in such a manner that a relative position of the receiving portion and the folding roller gap remains the same.

3. The cross-fold module according to claim 2, wherein the delivery portion of the delivery transport device remains stationary during the adjustment of the receiving portion.

4. The cross-fold module according to claim 1, wherein the belts are guided by way of a plurality of deflection rollers, wherein per belt at least two of the deflection rollers, jointly with the cross-fold knife and the pair of folding rollers, are adjustable in the same direction as the cross-fold knife and the pair of folding rollers.

5. The cross-fold module according to claim 4, wherein each belt runs in a U-shaped loop, wherein the curved portion of the U-shape runs about one of the adjustable deflection rollers.

6. The cross-fold module according to claim 5, wherein an accumulator formed by the U-shaped loop is filled or emptied during the adjustment of the deflection rollers.

7. The cross-fold module according to claim 1, wherein at least the cross-fold knife and the pair of folding rollers are fastened to a horizontally displaceable sliding frame.

8. The cross-fold module according to claim 1, wherein the cross-fold module comprises an infeed transport device which, jointly with the cross-fold knife and the pair of folding rollers, is adjustable in the same direction as the cross-fold knife and the pair of folding rollers.

9. The cross-fold module according to claim 8, wherein the infeed transport device is formed by at least one pair of mutually opposite, continuous belts between which portions of the sheet are sandwiched.

10. A folding machine having a cross-fold module, the cross-fold module having:

a bearing installation on which a sheet being infed in a feeding direction at least partially comes to bear;

a stop member against which a leading edge of the infed sheet comes to abut;

a cross-fold knife which is arranged above the bearing installation, extends in the feeding direction and is movable in a reciprocating manner in a folding-knife movement direction perpendicular to the feeding direction;

a pair of folding rollers, which are arranged below the bearing installation and opposite the cross-fold knife, and which form a folding roller gap in which a sheet is creased by the cross-fold knife for folding, thus forming a folded product; and a delivery transport device for the folded product, which is configured to receive the folded product in a receiving portion close to an outlet of the folding roller gap and to transport the folded product to a delivery portion in a direction transverse to the feeding direction and transverse to the folding-knife movement direction;

wherein the cross-fold knife and the pair of folding rollers are adjustable in a direction transverse to the feeding direction and transverse to the folding-knife movement direction;

wherein the delivery transport device is formed by at least one pair of continuous, driven belts, which belts are directly mutually opposite at least in a transport portion extending from the receiving portion to the delivery portion, and between which belts a portion of the folded product is sandwiched in the transport portion, and wherein the length of the transport portion is variable during the adjustment of the cross-fold knife and the pair of folding rollers.

11. The folding machine according to claim 10, wherein the folding machine, upstream of the cross-fold module, has a buckle-plate folding unit which is configured to fold the sheet multiple times in parallel in a first direction, and the cross-fold knife is configured to fold the pre-folded sheet in a second direction perpendicular to the first direction.

12. The folding machine according to claim 11, wherein the folding machine, downstream of the cross-fold module, has at least one further folding unit, which performs at least one further fold of the folded product in the second direction.

13. The folding machine according to claim 11, wherein the folding machine, downstream of the cross-fold module, has a plurality of folding units, which perform a plurality of further folds of the folded product in the second direction.

* * * * *